United States Patent [19]

McKibben

[11] Patent Number: 4,509,399

[45] Date of Patent: Apr. 9, 1985

[54] VIBRATION DAMPER FOR STRING MUSICAL INSTRUMENT

[75] Inventor: Jerry McKibben, Seneca, S.C.

[73] Assignee: Coats & Clark, Inc., Seneca, S.C.

[21] Appl. No.: 470,998

[22] Filed: Mar. 1, 1983

[51] Int. Cl.[3] ..... G10C 3/00

[52] U.S. Cl. ..... 84/216; 84/234; 84/297 R; 84/453

[58] Field of Search ..... 84/173, 199, 216, 219, 84/234, 255, 267, 273, 297 R, 312 R, 453

[56] References Cited

U.S. PATENT DOCUMENTS

| | | | |
|---|---|---|---|
| 1,371,506 | 3/1921 | Marx | 84/173 |
| 1,392,244 | 9/1921 | Cloetens | 84/234 |
| 1,849,463 | 3/1932 | Lindstedt | 84/199 |
| 1,859,553 | 5/1932 | Crane | 84/297 R |
| 3,971,287 | 7/1976 | Itó | 84/453 |
| 4,332,184 | 6/1982 | Phillips | 84/173 |

*Primary Examiner*—Lawrence R. Franklin

*Attorney, Agent, or Firm*—Burgess, Ryan & Wayne

[57] ABSTRACT

A plastic damper for attachment to a vibrating piano wire, the damper consisting of a single piece part having an end slot for turning by a screwdriver, and communicating peripheral slits for receiving the piano wire. One end of each peripheral slit has a slightly greater width than the rest of the slit, so that the piano wire can be inserted through this end of the slit, and locked against the damper by rotating it with a screwdriver, so that the relatively narrow major part of the slit "twist-locks" against the wire; the slight resiliency of the plastic facilitating the "twist-lock" action.

6 Claims, 7 Drawing Figures

VIBRATION DAMPER FOR STRING MUSICAL INSTRUMENT

BACKGROUND OF THE INVENTION

This invention relates to a vibration damper for a musical instrument having a vibratory string, and is particularly useful for damping vibrations of steel piano strings, although not limited thereto.

In order to improve the tonal quality of musical tones generated by piano strings, it is known to use various types of mechanical vibration dampers which are secured to the string to be damped. Such vibration dampers are disclosed, e.g., in U.S. Pat. Nos. 1,849,463; 1,859,553; 2,267,991; and 4,226,158. Such vibration dampers have generally included a number of separate piece parts which must be assembled together, as a result of which their manufacturing cost has been relatively high.

Accordingly, an object of the present invention is to provide an improved vibration damper for a string musical instrument, which damper is capable of being manufactured as a single piece part and at substantially lower cost than prior art vibration dampers.

SUMMARY OF THE INVENTION

As herein described, there is provided a generally cylindrical body for securing a wire, which may serve as a vibration damper for a musical instrument having a vibratory string with the given diameter. The cylindrical body comprises a yieldable material, said body having a pair of substantially coplanar oppositely disposed slits in the surface thereof, each slit having a width less than the diameter of a string to be secured therein, each slit subtending a radial angle greater than 90°, said slits communicating with each other through a cavity in said body capable of receiving said string, one end of each slit being enlarged to a diameter greater than the diameter of said string to be secured, the enlarged ends of said slits being disposed 180° apart, whereby said string may be inserted through said enlarged ends of said slit and said cavity and thereafter said string and body may be rotated relative to each other by engagement of a tool with said one end thereof, to cause said string to deform said body adjacent the edges of said slit, so that said string is secured to said body.

IN THE DRAWINGS

DETAILED DESCRIPTION

Figure 1:
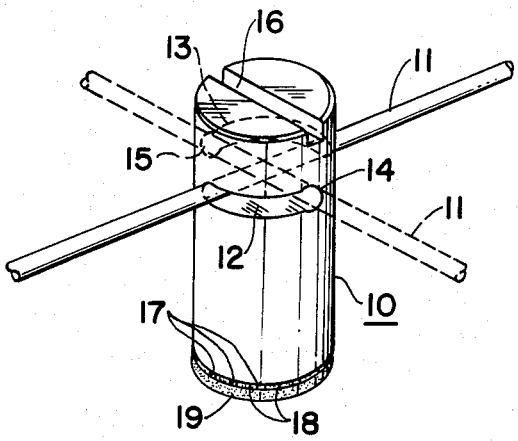
FIG. 1 is a perspective view showing a vibration damper according to a preferred embodiment of the invention, secured to a piano string.
Figure 2:
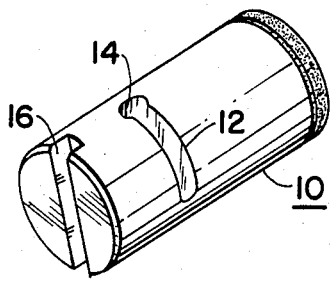
FIG. 2 is another perspective view of the vibration damper shown in FIG. 1.
Figure 3:
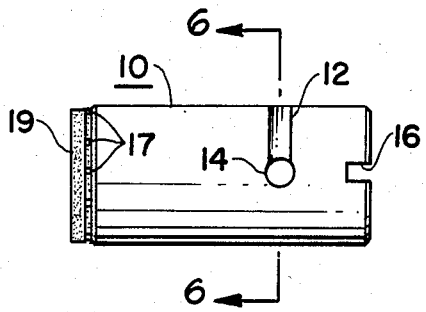
FIG. 3 is a top plan view of the vibration damper shown in FIG. 2.
Figure 4:
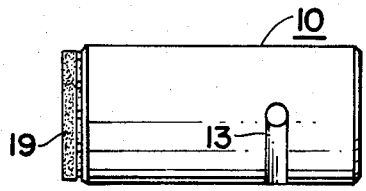
FIG. 4 is a right side elevation view of the vibration damper shown in FIG. 2.

As shown in FIG. 1, a vibration damper 10 is secured to a vibratory string 11 which may, for example, comprise one of the tone-generating steel strings of a piano. The string 11 extends transversely through the cylindrical body of the vibration damper 10, i.e. through oppositely disposed substantially coplanar slits 12 and 13 therein, and through an internal cavity (not shown) in the body of the vibration damper 10 with which the slits 12 and 13 communicate.

The body of the vibration damper 10 comprises a yieldable material, preferably a moldable resiliently yieldable plastic material such as acrylonitrile-butadiene-styrene (ABS).

Figure 6A:
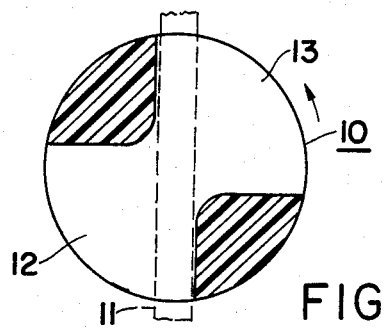
FIGS. 6(A) and 6(B) are cross sectional views taken along the cutting plane 6—6 of FIG. 3.
Figure 6B:
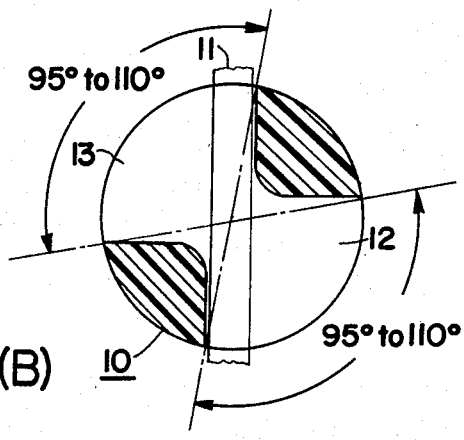

Each of the slits 12 and 13 subtends a radial angle greater than 90°, the preferred angle being in the range of 95° to 110° as best shown in FIG. 6(B). Both of the slits 12 and 13 subtend equal angles.

One end 14 of the slit 12 is enlarged to a diameter slightly greater than the diameter of the string 11. Similarly, one end 15 of the slit 13 is enlarged to the same diameter as the enlarged end 14 of the slit 12. The enlarged ends 14 and 15 are disposed 180° apart, i.e. along the same diameter through the longitudinal axis of the cylindrical body comprising the vibration damper 10.

The remaining portion of each of the slits 12 and 13 has a width slightly less than the diameter of the string 11.

For a typical piano string diameter of 0.090 inches, the width of the slits 12 and 13 may be on the order of 0.080 inches, while the diameter of the enlarged ends 14 and 15 thereof may be 0.093 inches.

One end of the vibration damper 10 has a transverse slot 16 therein for receiving a screwdriver to rotate the vibration damper 10. Alternatively, said end of the vibration damper 10 could be provided with a noncircular (hexagonal, for example) cross section, so that the vibration damper 10 could be rotated by means of a socket wrench or the like.

Figure 5:
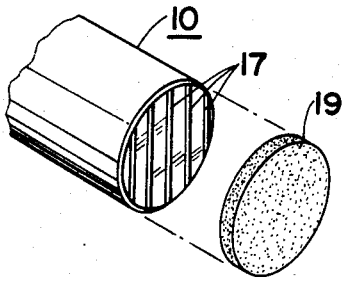
FIG. 5 is an exploded partial perspective view of one end of the vibration damper shown in FIG. 2.

The other end of the vibration damper 10 has a plurality of parallel ridges 17 formed thereon, as best seen in FIG. 5, to improve adhesion of the adhesive material 18 which secures a felt pad 19 to the corresponding end of the vibration damper 10. The felt pad 19 acts as a vibration absorbing material to reduce undesirable effects due to contact of the vibration damper 10 with a sounding board (not shown) or other surface adjacent the vibratory string 11.

The vibration absorber 10 is installed on the piano string 11 by inserting the piano string 11 through the enlarged ends 14 and 15 of the slits 12 and 13 (and of course the external cavity of the vibration damper 10 communicating therewith), the installation position of the string 11 relative to the vibration damper 10 being shown in dashed lines in FIG. 1. Then a screwdriver is inserted into the slot 16 to rotate the vibration damper 10 (counterclockwise as shown in FIG. 1) so that the string 11 becomes wedged at the other ends of the slits 12 and 13, resulting in a "twist-lock" type of locking action which secures the string 11 to the vibration damper 10. The installed position of the string 11 relative to the vibration damper 10 is shown in solid lines in FIG. 1.

Similarly, FIG. 6(A) shows the installation position of the string 11 relative to the vibration damper 10, while FIG. 6(B) shows the installed position of the string 11 relative to the vibration damper 10.

The resilience of the material of the vibration damper 10 permits it to be rotated to release the piano wire 11, which can then be removed via the enlarged ends 14 and 15 of the slits 12 and 13, so that the vibration damper 10 may be moved along the string 11 to another position and relocked thereto, to permit adjustment of the position of the vibration damper to optimize the tonal quality of the sound generated by the vibratory string 11.

What is claimed is:

1. A vibration damper for a musical instrument having a vibratory string with a given diameter, comprising:

a cylindrical body comprising a yieldable material, one end of said body having means for receiving a tool to rotate said body about the longitudinal axis thereof, said body having a pair of substantially coplanar oppositely disposed slits in the surface thereof, each slit having a width less than the diameter of a string to be secured therein, each slit subtending a radial angle greater than 90 degrees, said slits communicating with each other through a cavity in said body capable of receiving said string, one end of each slit being enlarged to a diameter greater than the diameter of said string to be secured, the enlarged ends of said slits being disposed 180 degrees apart, whereby said string may be inserted through said enlarged ends of said slits and said cavity, and thereafter said body may be rotated by engagement of a tool with said one end thereof, to cause said string to yieldably deform said body adjacent the edges of said slits, so that said string is secured to said body.

2. The damper according to claim 1, wherein said cylindrical body comprises a moldable resiliently yieldable plastic material.

3. The damper according to claim 1, wherein said body comprises acrylonitrile-butadiene-styrene.

4. The damper according to claim 1, wherein each slit subtends a radial angle in the range of 95 to 110 degrees.

5. The damper accordingly to claim 1, wherein said tool receiving means comprises a transverse slot in said one end of said body.

6. The damper according to claim 1, wherein the other end of said body opposite said tool receiving end has a plurality of ridges thereon, further comprising a pad of a vibration-absorbing material secured to said other end of said body.

* * * * *